United States Patent [19]

Rigter

[11] Patent Number: 4,825,921

[45] Date of Patent: May 2, 1989

[54] BLINDS, SCREENS, PARTITIONS AND DOORS

[76] Inventor: Steven M. Rigter, 18 Riviera Road, Miami, 4220, Queensland, Australia

[21] Appl. No.: 47,877

[22] Filed: May 6, 1987

[30] Foreign Application Priority Data

May 7, 1986 [AU] Australia ..... PH5775

[51] Int. Cl.[4] ..... E06B 9/08

[52] U.S. Cl. ..... 160/23.1; 160/271

[58] Field of Search ..... 160/23 R, 31, 37, 238, 160/264, 266, 268 R, 270, 271, 273 C, 305

[56] References Cited

U.S. PATENT DOCUMENTS

| | | | |
|---|---|---|---|
| 1,873,156 | 8/1932 | Seide | 160/23 R |
| 1,880,589 | 10/1932 | Traut | 160/271 |
| 1,885,756 | 11/1932 | Norquist et al. | 160/271 X |
| 1,934,103 | 11/1933 | Traut | 160/23 R |
| 2,855,035 | 10/1985 | Mich | 160/23 R |
| 3,116,097 | 12/1963 | Novaler | 160/271 X |
| 4,638,844 | 1/1987 | Hayashiguchi | 160/23 R |
| 4,707,018 | 11/1987 | Gavagan | 160/23 R X |

FOREIGN PATENT DOCUMENTS

| | | | |
|---|---|---|---|
| 1304727 | 1/1973 | United Kingdom | 160/238 |

*Primary Examiner*—Robert W. Gibson, Jr.
*Attorney, Agent, or Firm*—Renner, Otto, Boisselle & Sklar

[57] ABSTRACT

A screen assembly is provided having a web or sheet of material and a pair of spaced opposed elongate strengthening and supporting elements. A respective supporting element is secured to or formed along an edge of the material and each element is made from a relatively thin resilient non-extensible material. The assembly includes two opposed guide rails relative to which a respective element is received and guided for movement. The assembly includes a take-up roll on to and from which the material may be retracted and withdrawn.

13 Claims, 11 Drawing Sheets

BLINDS, SCREENS, PARTITIONS AND DOORS

The invention relates to improvements in blinds, screens, partitions and doors.

Screens such as insect screens of a variety of different types are known. Such screens have various characteristics or features depending upon whether they are intended for use in doorways or with windows. When used with windows a variety of distinct types have been developed for sliding, double hung, casement, hopper or other window constructions. Similarly screens are constructed in different ways for sliding and swinging doors.

There has always been a tendancy for land prices to be at a premium for sites having an aesthetic outlook or view. Screen constructions to date have been such that they permanently obstruct a considerable area of a window or door and thus detract from or diminish the quality of the view through the window or door. Even with sliding windows or doors the screen, whilst it may be mounted for sliding movement relative to the window or door, nevertheless obstructs the view through either the door or window or an adjacent glass panel.

Some windows, because of their construction require window winders to enable the opening or closing of the window if the window is fitted with a screen. This is the case with hopper windows. This adds to the cost of screening a window against insects. One attempt at solving this problem has been to form a movable panel in the screen which may be opened to provide for access to the window to facilitate opening thereof. This panel is then closed once the window is opened. Such screens are a nuisance in their operation and still do not solve the problem of obstructing vision through the window.

Folding partitions, doors or screens have been proposed to either divide off a room or door opening. The construction of such partitions or screens did not lend themselves to easy erection and generally, when in the inoperative position, were unsightly and tended to be bulky and in some cases decreased the available width of the door opening. Such partitions, screens or doors, because of their constructions usually required the presence of tracks in which the screen could move or by which the screen was supported and guided during movement from a retracted to an extended position. In some instances additional support other than that afforded by the tracks was required.

It has previously been proposed to have screens which may be withdrawn from a roll and extended across a window when required and which may be withdrawn into the roll when screening of the window was no longer required. Such arrangements enabled an unimpeded view through the window to be obtained. Such screens had opposed guide tracks in which rollers or frictional guide members were held captive. Such rollers or members were bulky and because of this did not form a neat compact shaped roll within a take-up housing for the roll.

In many cases, standard insect screen doors, although very necessary are impractical. Most of the time the entrance door is closed but the screen door is also closed and extends over the door opening unnecessarily covering the opening when the entrance door is shut. When one needs to pass through two doors need to be opened and this can be a nuisance.

An insect screen door is generally only required when the entrance door is to be left open and is superfluous at other times.

Where entrance doors open outwardly insect screen doors need to be mounted inside the dwelling and are unsightly. In some instances the mounting of insect screen doors is not only unsightly but dangerous. Such a situation occurs where doors are mounted at the top of a flight of stairs. In such instances the user must take a step backwards, open the screen door and step around it to pass through the doorway.

Where french doors are fitted and screen doors are employed these screen doors usually detract from the aesthetic appeal of the doors and where the french doors are fitted with screen doors the availability of the extra wide opening is rendered useless.

Partitions are sometimes formed so that the partition in one position extends across a room or passage an in another position folds concertina-like to open up the room or passage. When folded in this way considerable space is consumed making the passage narrower than would otherwise be the case. Concertina partitions or folding doors are not suitable for all locations. For example such partitions are unsuitable for use in an archway and where the passage is too narrow.

It is an object of the invention to provide a blind, screen, partition or door which at least minimises some of the disadvantages referred to above.

According to one aspect of the invention there is provided a screen assembly comprising a web or sheet of material and a pair of spaced opposed elongate strengthening and supporting elements each said element being secured to or formed along an edge of the material, said elements being made from a relatively thin resilient non-extensible material, two opposed guide rails relative to which the elements are received and guided for movement, and a take-up roll onto and from which the screen may be retracted and withdrawn.

The web or sheet may comprise woven or non-woven material. For example the web or sheet may be a sheet made from fabric, metallic or non-metallic material. Where the web or sheet is solely intended to inhibit the passage of insects a foraminous material either of plastics or metal may be used. Where the web or sheet is not solely intended to inhibit the passage of insects but also serves as a blind to screen off a portion of a window or door so that the view through that portion is impeded, a sheet of fabric or sheet of metallic or non-metallic material may be used. The sheet has two opposed edges which, when the take-up roll is vertically oriented extend horizontally in use when the sheet is withdrawn from the roll. When the take-up roll is horizontally oriented the opposed edges may extend vertically when the sheet is withdrawn from the roll.

The strengthening and supporting elements, as mentioned above may have a curved transverse cross section. Thus the element has one surface which is concave in shape and another surface which is convex in shape. The element may readily be rolled up in a direction of the concave surface. This will be termed "the preferred direction". Because of the transverse contour of the element the element assumes a substantially straight configuration when unrolled and if it is rolled or bent in a direction opposite to the preferred direction it "clicks" or returns to the substantially straight configuration when released or unrestrained. Alternatively, the element may be flat in transverse cross section. The elements are preferably made from metal. Spring steel has been found suitable although they may be made from other metallic materials or plastics. In one embodiment, the elements are of negligible thickness and width and this may be about 2cm and of a length commensurate with the length of the web or sheet.

The elements may be formed separate from the web or sheet and secured or attached thereto. Alternatively, the elements may be formed integrally with the web or fabric and extending along opposed edges thereof.

The take-up roll may include a housing with an access opening through which the web or sheet may extend. The housing may be substantially cylindrical. The take-up roll may include a spindle or shaft around which the web or sheet may be wound. It is preferred that the spindle be biassed to tend to withdraw the web or sheet onto the spindle. The biassing means may include a spring.

If desired further elements in addition to the two opposed elements may be present. These elements may either extend parallel and/or perpendicular to the two opposed elements and thereby lend a further degree of rigidity to the sheet or web.

In use the blind or screen may be guided in tracks during its movement into and out of the take-up roll. The tracks extend adjacent the opposed edges of the web or sheet and may be substantially channel shaped. The elements may be a loose fit within the channel shaped tracks. Preferably the tracks are secured adjacent a window or door and are substantially parallel to one another. The tracks may have two opposed arms, a web extending between ends of the arms and the free ends of the arm forming an opening into which the elements may extend. One of the arms may be longer than the other. This long arm may be fixed to the window or door. Preferably one of the arms is directed to taper towards the other.

In the other aspect of the invention where a partition or door is provided the plurality of juxtaposed elements are such that the concave faces all are directed to one side of the body portion when the elements are not flat. Each element may be constructed and have the same features and characteristics of the elements of the screen of the first aspect of the invention.

In this aspect of the invention the take-up roll may include a housing. The housing may be substantially cylindrical although other shapes may be used. It is preferred that the housing be substantially self supporting whereby it may be placed in a free standing position at a desired location from which a partition or screen is required to extend.

The take-up roll may include a support structure to assist in maintaining the roll in a desired free standing position. However the roll, rather than being free standing may be secured to a support such as a wall, door frame or other fixed structure. The support structure of the present invention may comprise a foot. The foot may be movable between a stowing position to a supporting position. The foot may. comprise an elongate member pivotally mounted to the roll. The elongate member is preferably of channel cross section whereby it may guide and support an edge of the body portion as it is withdrawn from the roll and also after it has been withdrawn to the desired degree.

Particular preferred embodiments of the invention are illustrated in the drawings in which.

Figure 1:
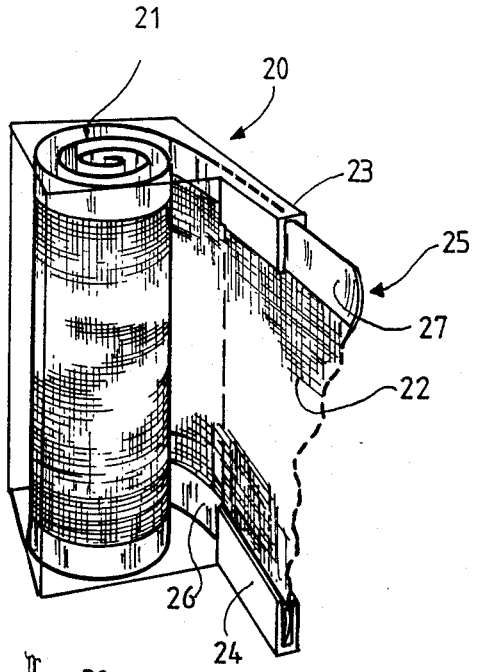
FIG. 1 is a diagrammatic view of a screen according to an embodiment of the invention.
Figure 2:
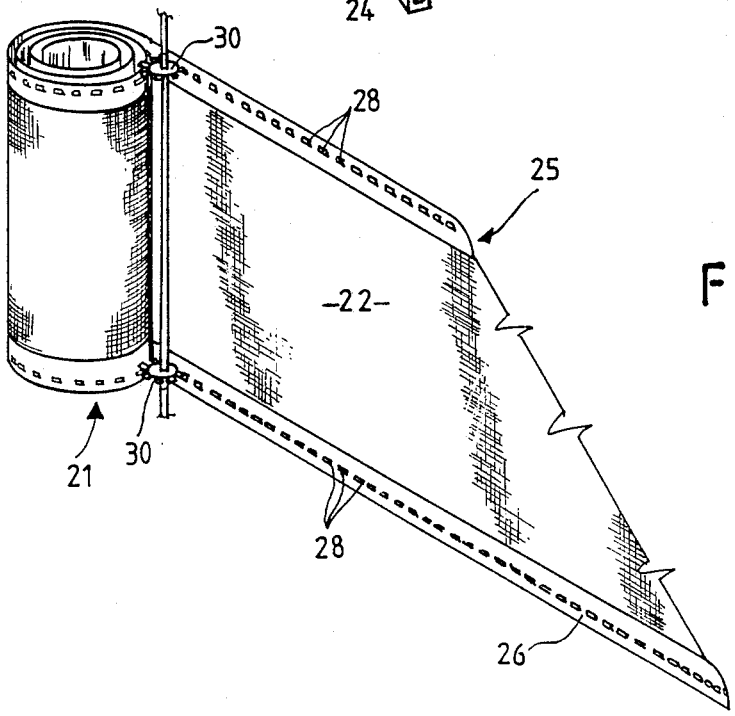
FIG. 2 is another diagrammatic view of a screen according to an embodiment of the invention.

FIG. 1 shows a blind or screen 20. The arrangement 20 includes a take-up roll 21, a web or sheet of foraminous material 22 and two opposed guide tracks 23 and 24. Material 22 may be fly wire mesh for example and has secured to opposed edges elongate strengthening and supporting elements 25, 26. Elements 25, 26 are relatively thin and when unrolled from roll 21 are arcuate in transverse cross section although they may be flat if desired. Elements 25, 26 (when unrolled) have a concave face 27 and an opposed convex face (not shown). When the material 22 and the elements are rolled up within roll 21 the elements substantially flatten and may then form a tight roll within roll 21 and do not take up substantially more space within the take-up roll 21 than the coiled up material 22. From FIG. 1 it is apparent that the elements are rolled up in the direction of the concave face 27. This is the preferred direction for rolling up of the blind or screen when the elements are arcuate in transverse cross section.

The blind or screen 20 may be placed adjacent a window or door opening and the material may be drawn across the opening when desired and secured in place. Alternatively, the roll 21 may be built into the structure of a building and thus hidden from view.

In FIG. 3 the roll 21 has been shown removed from a housing or enclosure. In this embodiment elements 25, 26 are provided with sprocket holes 28. A spindle 29 is located adjacent the roll 21 and carries spaced sprockets 30. The sprockets on the spindle cooperate with the holes 28. By rotation of the spindle the screen may be rolled and unrolled.

Figures 3A, 3B, 3C:
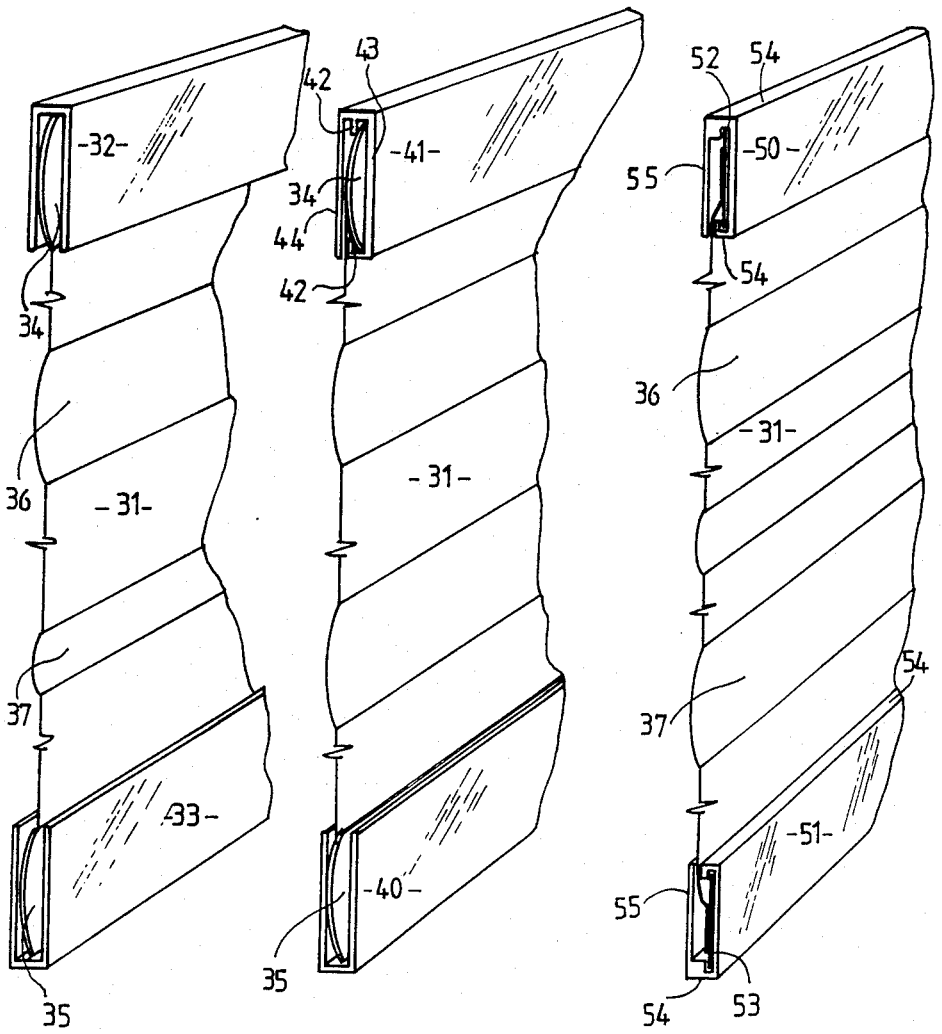
FIG. 3A is a fragmentary view of part of a screen according to one embodiment.
FIG. 3B is a fragmentary view of an alternative embodiment to that of FIG. 3A.
FIG. 3C is a fragmentary view of an alternative embodiment to that of FIG. 3B.

FIG. 3A shows a screen 31 extending between two channel shaped rails or guides 32, 33. A reinforcing element 34, 35 or arcuate shape is arranged at each side of the screen. Elements 34, 35 travel within rails 32, 33. Further reinforcing elements 36, 37 are located on the screen intermediate the rails 32, 33.

In FIG. 3B the bottom rail 40 may be the same configuration as rail 33 of FIG. 3A or alternatively may have the same configuration as the top rail 41. Rail 41 has two short inwardly directed flanges 42 and a front face 43. Element 34 is held between flanges 42 and face 43. The web of foraminous or other material 31 to which element 34 is secured projects out from the top rail 41 between rear face 44 and the lower short flange 42.

In FIG. 3C reinforcing elements 52, 53 are flat and locate relative to opposed grooves in short side faces 54 of rails 50, 51. The material 31 is secured to elements 52, 53 and projects out between rear face 55 and one of the short faces 54.

Figure 4:
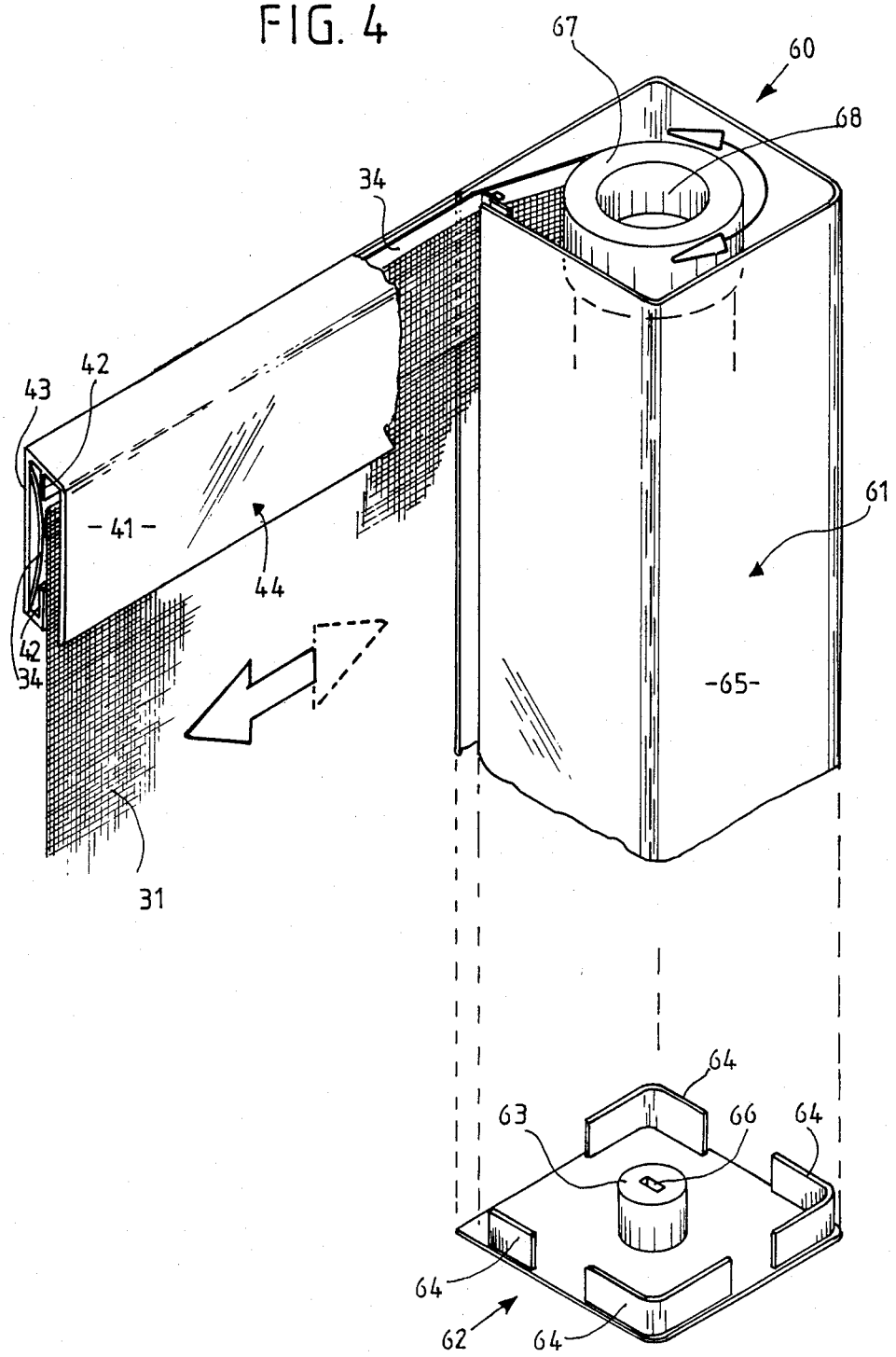
FIG. 4 is a detailed fragmentary perspective view of a screen according to the invention.
Figure 5:
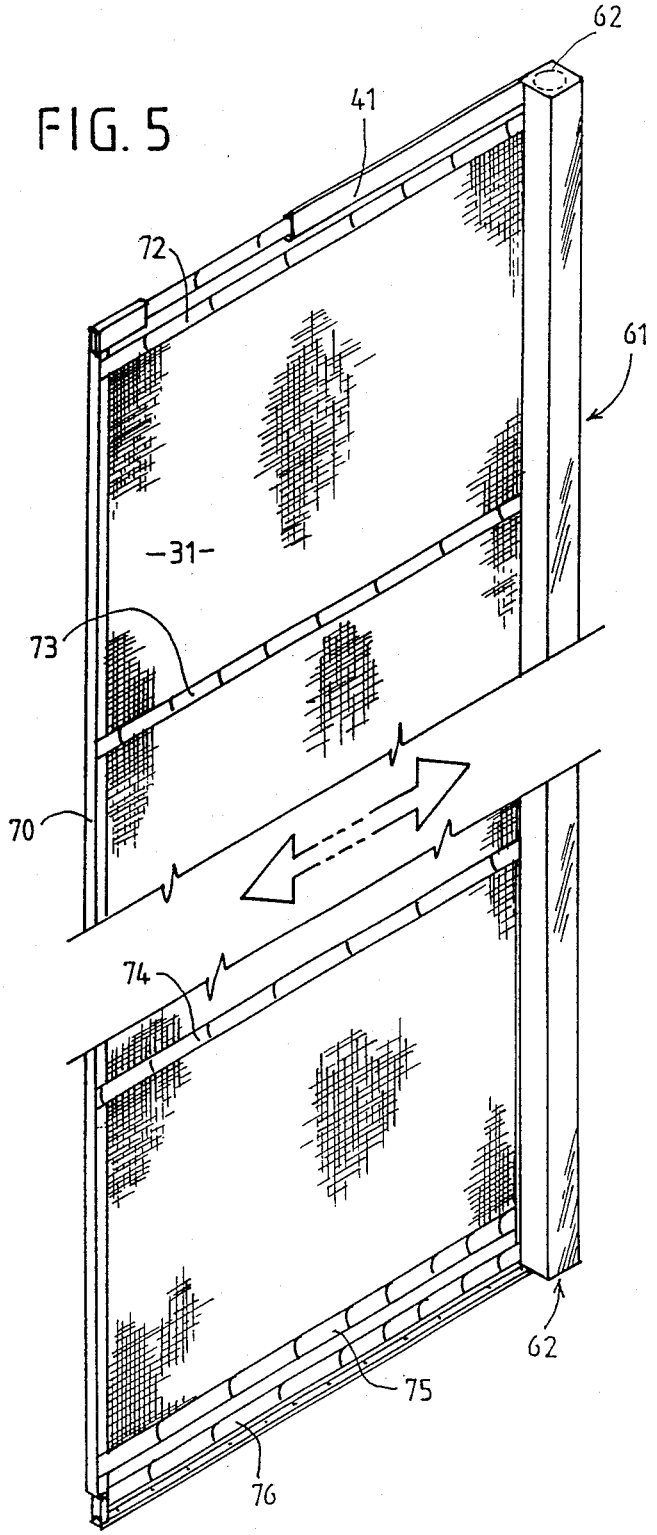
FIG. 5 is a fragmentary perspective view of an alternative to that of FIG. 4.

FIG. 4 shows a screen assembly 60 having an enclosure or housing 61. The housing 61 includes two end caps 62 (only one of which is shown). Cap 62 has a boss 63 and outwardly directed locating tabs 64 which locate within the wall 65 of the housing. Box 63 has a slotted recess 66. A shaft 67 is located within the housing 61 and boss 63 locates within recess 68. Not visible within the recess is an extension which mates with slotted recess 6. The shaft is constructed like a spring rod for a roll-up blind and functions in the same manner whereby it enables the material 31 to be withdrawn from the housing 61 and held at a particular desired extension therefrom. In addition by manipulation of the material 31 it may be withdrawn into the housing 61 by the spring action of the shaft 67.

A guide rail 41 extends outwardly from the housing. Two such rails would normally be present but only one is shown. Rail 41 is identical to the top rail of FIG. 3B.

Figure 6A:
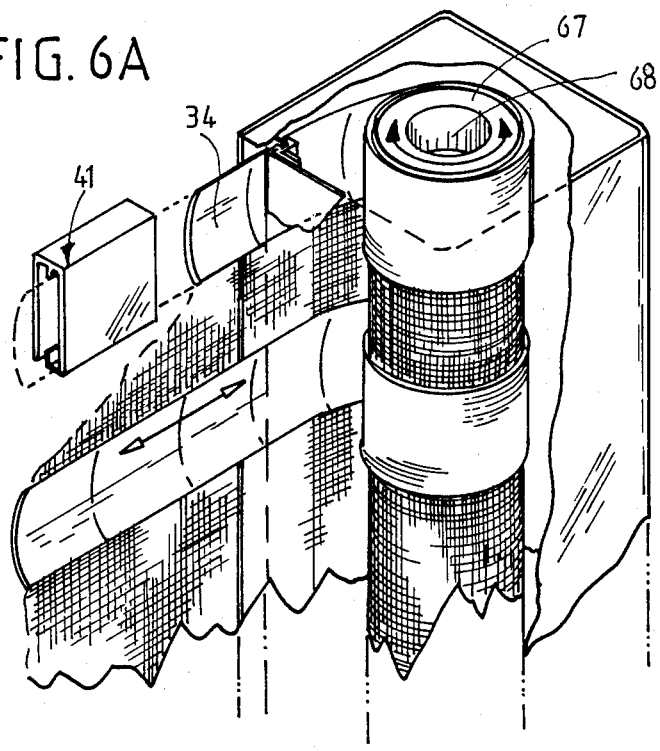
FIGS. 6A, 6B, 6C and 6D are detailed views of part of the screen of FIG. 5.
Figure 6B:
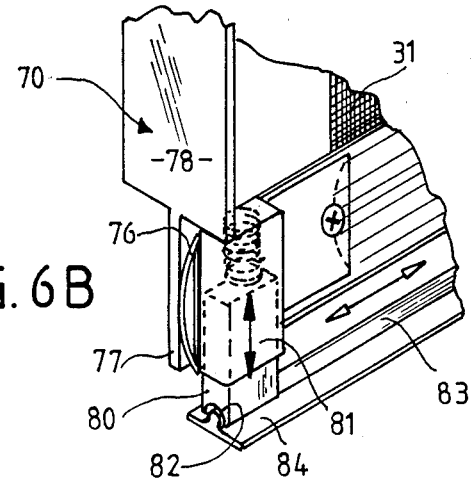

FIGS. 5 and 6A to 6D show an alternative to the screen assembly of FIG. 4. In this figure the assembly has a housing 61 much like that shown in FIG. 4. Guide rail 41 extends from an end of the housing 61 to a frame member 70. Rail 41 may face either as shown in FIG. 6A or as in FIG. 4. Within housing 61 in FIG. 6A the shaft 67 can be seen and end cap (like cap 62) has been removed. A plurality of reinforcing elements 72, 73, 74, 75 and 76 are located along the width of material 31. Frame member 70 is T shaped in transverse cross section and has a web 77 which is co-planar with the material 31 and a web 78 which is at ninety degrees to it.

Figure 6C:
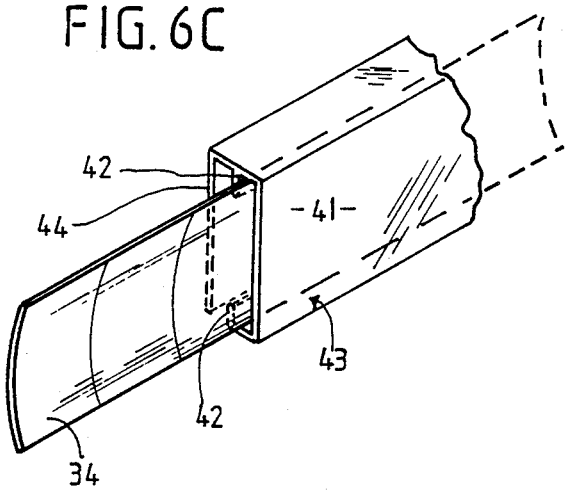
Figure 6D:
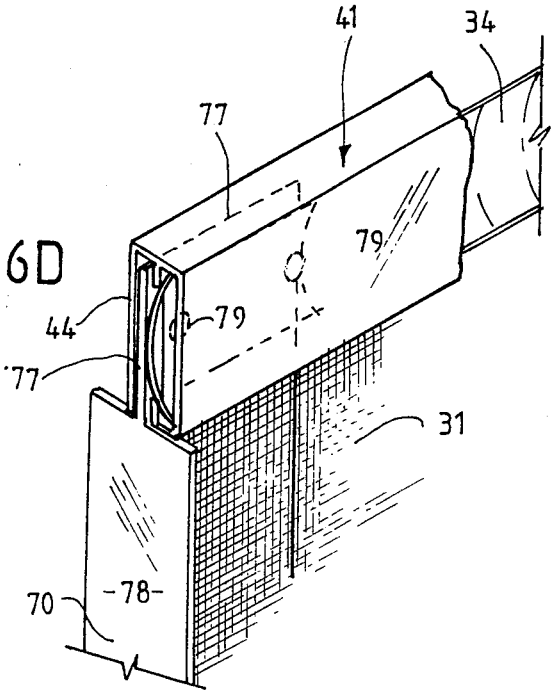

In FIGS. 6C and 6D the manner in which element 34 locates within rail 41 is shown. The material 31 extends between face 44 and the lower short flange 42. Web 77 continues on past web 78 and is located against the interior surface of face 44. Fasteners, such as rivets 79 secure element 34 to web 77 with material 31 trapped between them.

At the lower or other end of the frame member 70 a spring biased block 80 is located within sleeve 81. The sleeve 81 is secured to web 77 with element 76 between them. Block 80 has a recess 82 within which locates a rib 83 extending along strip 84. In this way the movement of element 76 is guided as it extends out of and returns into the housing 61.

Figure 7:
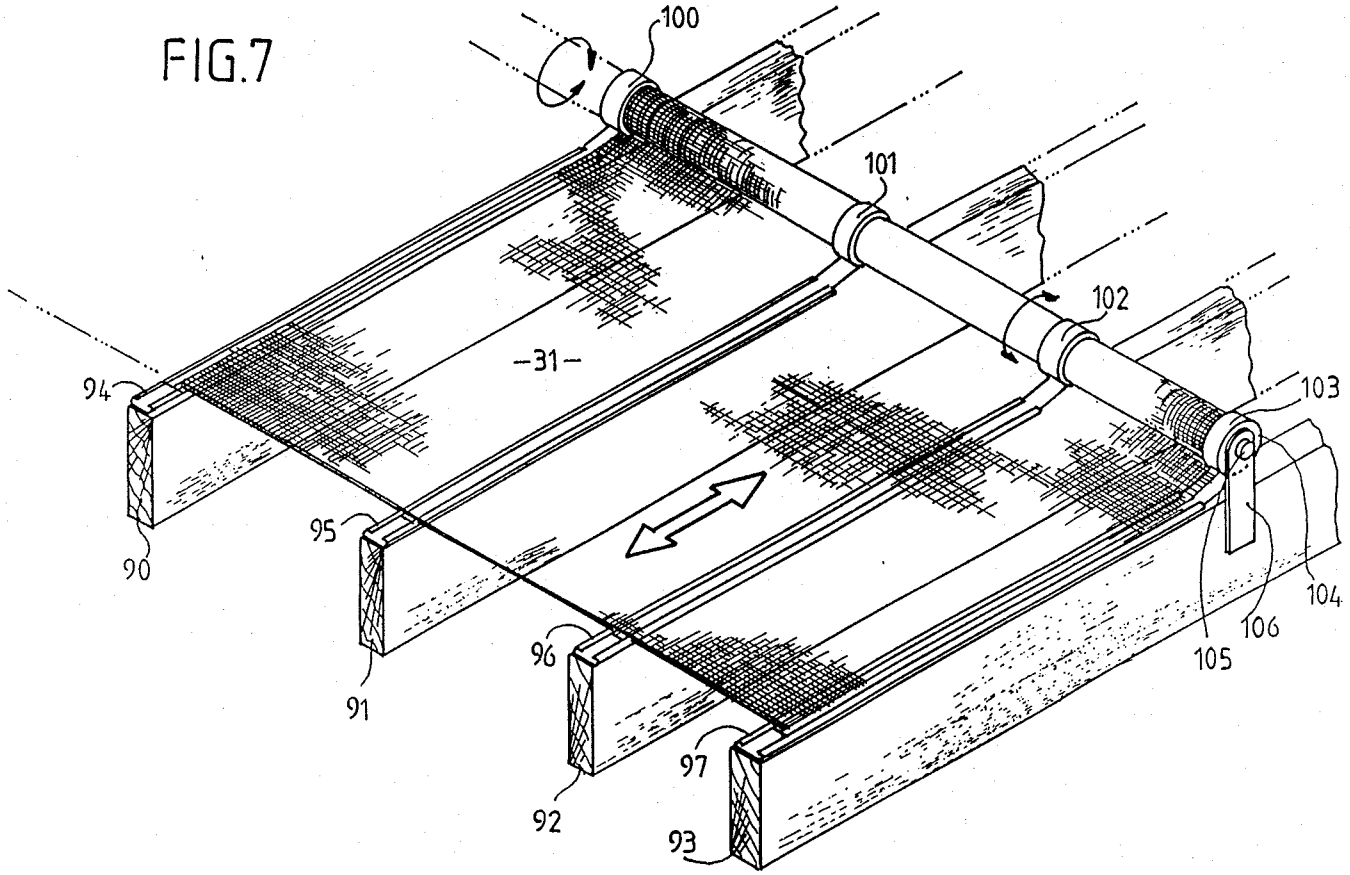
FIG. 7 is a perspective view of an alternative screen.
Figure 8B:
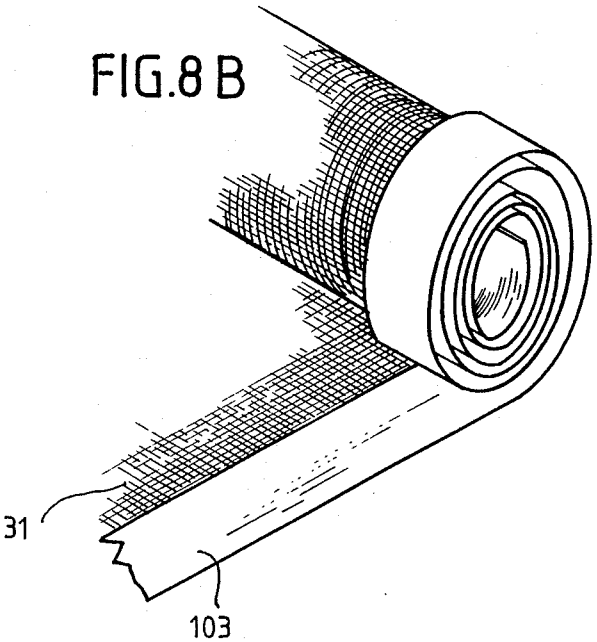
FIGS. 8A and 8B are detailed views of portions of the screen of FIG. 7.
Figure 8A:
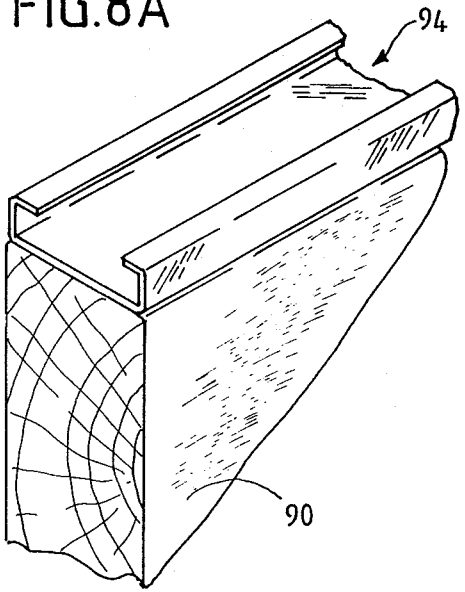

FIG. 7 shows an alternative use of the screen of the invention and is particularly suitable for use as a pergola or the like for example. Beams 90, 91, 92, 93 carry guide channels 94, 95, 96 and 97 relative to which elements 100, 101, 102 and 103 may move. A spindle 104 having a pin 105 at either end is held relative to the beams by support bracket 106. Spindle 104 may be a spring loaded shaft like that employed with a roller blind. The material 31 may be withdrawn from and rolled up on the spindle as desired. The elements 100, 101, 102, 103 may be made from a plastics material and heat formed to tend to assume or prefer towards a roller state as illustrated in FIG. 8B. In this way the rolling up of the material 32 may be enhanced and a spring loader spindle may not be necessary.

Figure 9:
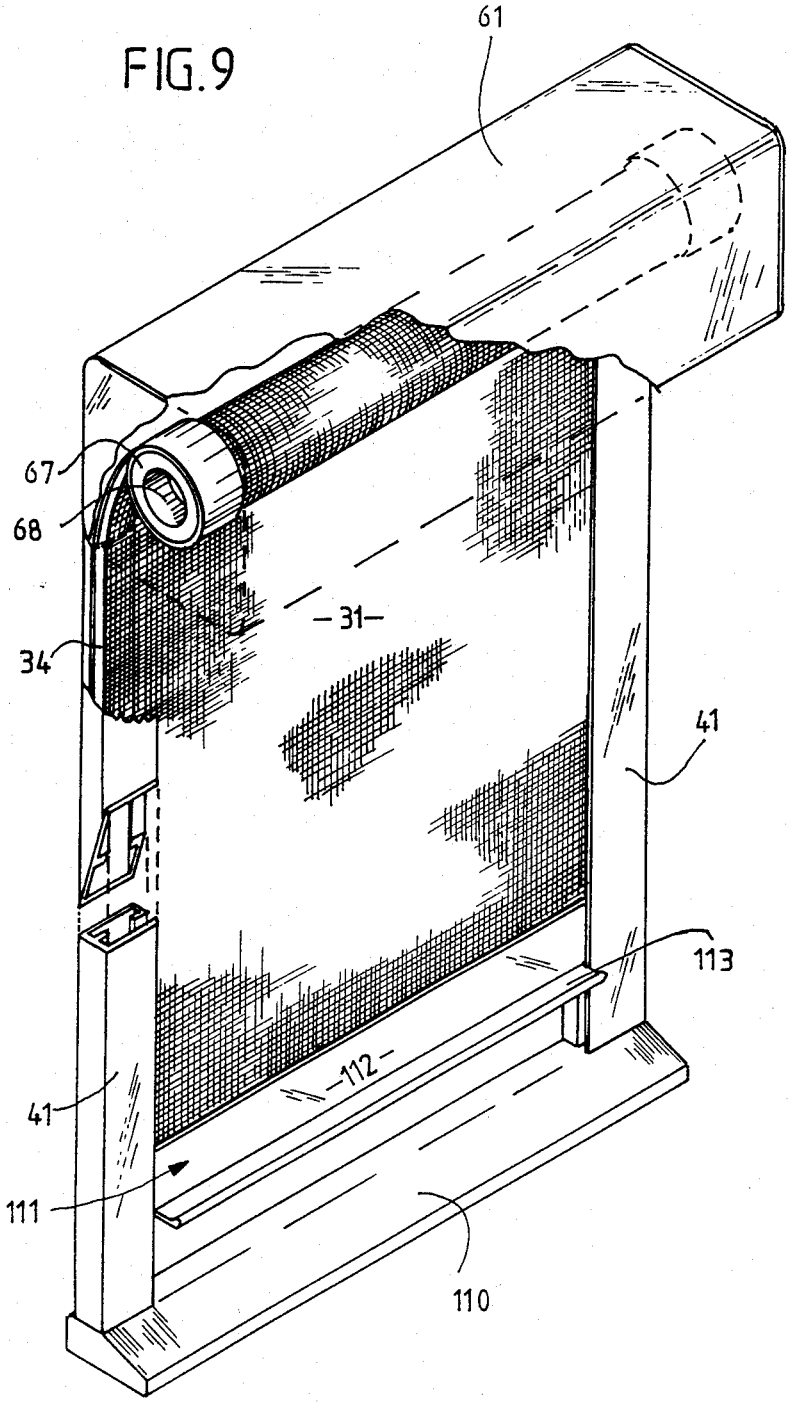
FIG. 9 is a detailed view of a screen suitable for a window.

As shown in FIG. 9 a screen assembly may be mounted on a sill 110 of a window (not shown). The housing 61 can be arranged to extend horizontally above the window and a free edge of the material 31 may have a frame member 111 secured thereto. Member 111, like member 70 may be substantially T shaped in transverse section having a web 112 co-planar with material 31 and web 113 at right angles to it. Web 113 may readily be grasped by the user. Web 112 projects into rails 41. The assembly of this figure may be installed adjacent a window and material 31 may be a foraminous screen which, when in the position shown, would cover the window opening and prevent insects from passing.

Figure 10:
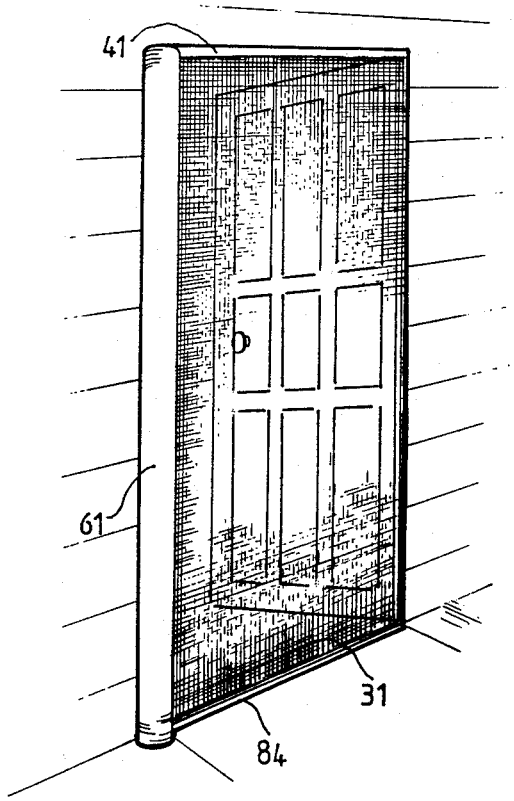
FIG. 10 shows how a screen of the invention may be mounted relative to a door.
Figure 11:
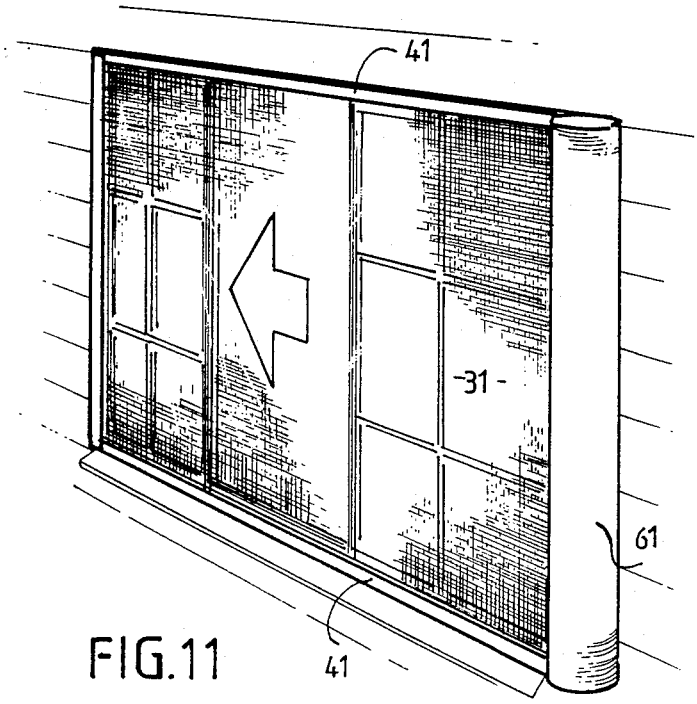
FIG. 11 shows one way in which a screen may be mounted relative to a window.

FIGS. 10 and 11 show typical ways in which the assembly of FIG. 9 may be used. In FIG. 10 housing 61 is mounted adjacent a door opening. A strip 84 (like that shown in FIG. 6B) extends across the floor and a rail 41 across the head of the door opening. In FIG. 11 housing 61 is located adjacent a window and the material 31 is guided for movement across the window by rails 41.

Figure 12:
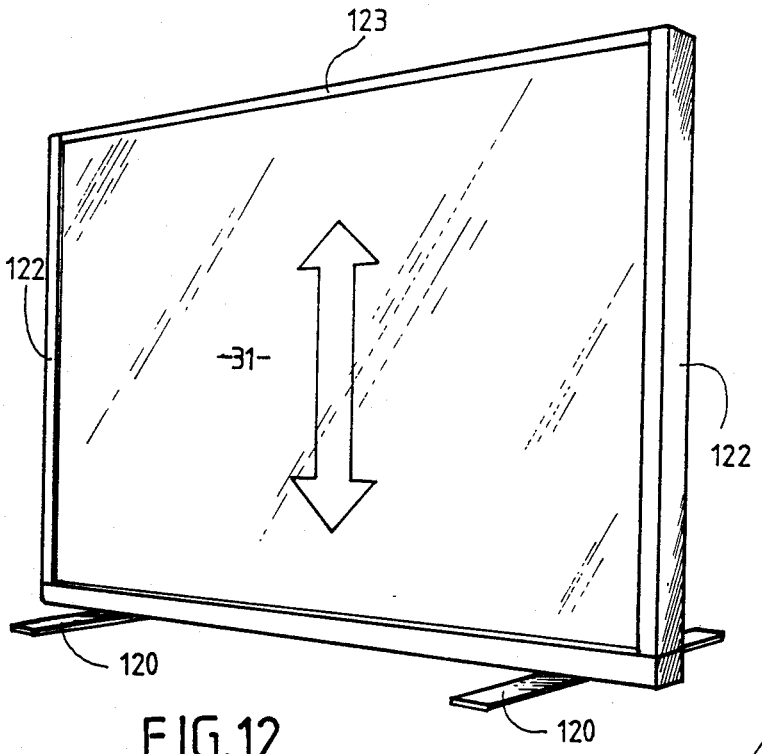
FIG. 12 shows how a screen according to an embodiment of the invention may be used as a partition; and, FIG. 13 shows how the screen of FIG. 12 may be erected.
Figure 13:
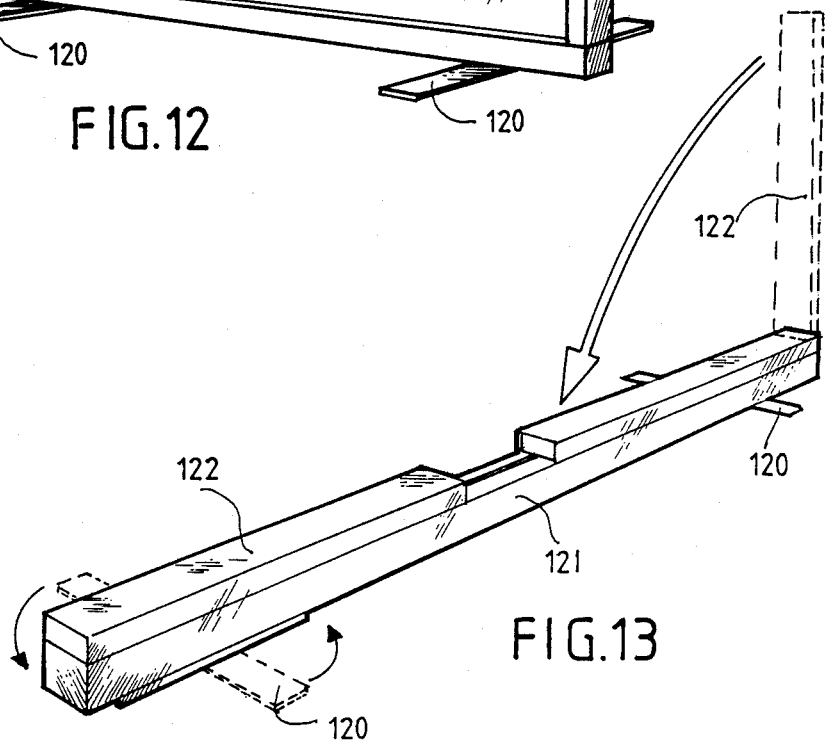

With reference to FIG. 12 and 13 a free standing partition is shown. The partition has feet 120 which may be moved from the position shown to a position extending along housing 121. The housing has rails 122 (like rails 41) pivotally mounted thereto so that they may be moved from a position parallel with the housing 121 to the upstanding position of FIG. 12. When in the FIG. 12 position material 31 may be withdrawn from the housing 121. An edge of the material may have mounted thereto a frame member 123 (like member 70).

The screen assembly of the invention may be employed to inhibit the passage of insects into a room through a door or window opening. Since the screen may be extended and retracted as desired it does not impede the view thrugh a door or window. If desired, the screen assembly or the blind or partition of the invention may be mounted with the take-up roll concealed within framework or wall of a building to provide a partition adjacent a window, door, or other desired location. Since the elongate supporting elements are substantially rigid when extended they ensure that a relatively rigid screen or partition is provided. In addition, these elements may be wound up and assume a substantially flat lateral cross section in this condition and therefore do not substantially add to the bulk of a rolled up screen blind or partition.

I claim:

1. A screen assembly comprising a web or sheet of material, a pair of spaced opposed elongate strengthening and supporting elements, a respective said element being secured to or formed along an edge of the material, said element being made from a relatively thin resilient non-extensible material, two opposed guide rails relative to which a respective said element is received and guided for movement and a take-up roll onto and from which the material may be retracted and withdrawn, said assembly including integrally formed intermediate strengthening and supporting elements located between the elements at the edge of the material, at least some of said elements having an arcuate transverse cross-section.

2. The assembly of claim 1 wherein the rails have a front face, a rear face, short side faces extending between the front and rear faces with a longitudinal gap extending along one said short face, inwardly directed flanges on said short side faces whereby an associated said element locates between said front face and said short flanges and said material projects out from said rail through said longitudinal gap.

3. The assembly of claim 1 wherein said take-up roll includes a spring loaded shaft or spindle.

4. The assembly of claim 3 including a housing within which said take-up roll is located, said housing having a longitudinal opening from which the material may be withdrawn and through which the material may be returned to the take up roll.

5. The assembly of claim 4 wherein said housing has end caps relative to which the spindle locates.

6. The assembly of claim 5 wherein each said end cap has an inwardly directed spindle receiving boss and inwardly directed housing locating tabs.

7. The assembly of claim 1 wherein at least one guide rail is channel shaped.

8. The assembly of claim 1 including a frame member to which a free edge of the material is secured, said frame member being substantially T shaped in transverse cross section and having a first web co-planar with the material and to which the material is secured and a second web at right angles to said first web at least one end of said first web being received by a respective said guide rail.

9. The assembly of claim 1 wherein said material comprises a foraminous screen.

10. A screen assembly comprising a web or sheet of material, a pair of spaced opposed elongate strengthening and supporting elements, a respective said element being secured to or formed along an edge of the material, said elementing being made from a relatively thin resilient non-extensible material, two opposed guide rails relative to which a respective said element is received and guided for movement and a take-up roll onto and from which the material may be retracted and withdraw, said assembly further including a frame member to which a free edge of the material is secured, a said frame member being substantially T-shaped in transverse cross section and having a first web co-planar with the material and to which the material is secured and a second web at right angles to said first web at least one end of said first being received by a respective said guide rail, and wherein one guide rail comprises a strip having a longitudinally extending guide bear and said frame member includes a guideblock resiliently urged against said bead.

11. A screen assembly including a take-up roll of material mountable to span between a plurality of parallel beams, a channel shaped guide rail securable to each beam and a like plurality of elongate relatively thin resilient non-extensible support elements each mounted to the material, a respective said element being received and guided by a respective said rail, said elements being heat treated to assume a preferred rolled-up or coiled configuration.

12. A screen assembly for use as a screen for a window comprising a web or sheet of material, a pair of spaced opposed elongate strengthening and supporting elements, a respective said element being secured to or formed along an edge of the material, said element being made from a relatively thin resilient non-extensible material, two opposed guide rails relative to which a respective said element is received and guided for movement and a take-up roll onto and form which the material may be retracted and withdrawn.

13. A screen assembly for use as a screen for a door comprising a web or sheet of material, a pair of spaced opposed elongate strengthening and supporting elements, a respective said element being secured to or formed along an edge of the material, said element being made from a relatively thin resilient non-extensible material, two opposed guide rails relative to which a respective said element is received and guided for movement and a take-up roll onto and from which the material may be retracted and withdrawn.

* * * * *